United States Patent [19]

Togashi

[11] 4,175,308

[45] Nov. 27, 1979

[54] GATHERING THE ENDS OF HEAT-CONDUCTING PIPES IN HEAT EXCHANGERS

[76] Inventor: Akira Togashi, 14-31, 6-chome, Ryoke, Urawa-shi, Saitama-ken, Japan

[21] Appl. No.: 667,108

[22] Filed: Mar. 15, 1976

[30] Foreign Application Priority Data

Mar. 19, 1975 [JP] Japan ..... 50-33227

[51] Int. Cl.[2] ..... B23P 15/26

[52] U.S. Cl. ..... 29/157.3 C; 29/157.4; 165/177; 165/178; 165/DIG. 13

[58] Field of Search ..... 29/157.3 A, 157.3 R, 29/157.4, 157.3 C, 157.3 B; 165/177, 178

[56] References Cited

U.S. PATENT DOCUMENTS

| | | | |
|---|---|---|---|
| 745,254 | 11/1903 | Sneddon | 29/157.4 |
| 1,284,578 | 11/1918 | Branzell | 29/157.3 AH |
| 1,708,229 | 4/1929 | McClellon | 29/157.4 |
| 2,313,315 | 3/1943 | Blais | 29/157.3 R |
| 2,337,584 | 12/1943 | Baker | 29/157.3 R |
| 2,415,865 | 2/1947 | Booth | 29/157.3 R |
| 2,443,574 | 6/1948 | Burns | 29/157.3 R |
| 2,498,827 | 2/1950 | Shaw et al. | 29/157.3 R |
| 2,618,256 | 11/1952 | Olson | 165/177 X |
| 2,691,813 | 10/1954 | Polad | 29/157.3 AH |
| 2,926,003 | 2/1960 | Pulsifer | 29/157.3 R |
| 2,983,993 | 5/1961 | Johnson | 29/157.3 X |
| 3,024,521 | 3/1962 | Polk | 29/157.3 R |
| 3,627,039 | 12/1971 | Tiefenbacher | 29/157.4 |
| 3,897,821 | 8/1975 | Babunovic et al. | 29/157.4 |

FOREIGN PATENT DOCUMENTS

| | | | |
|---|---|---|---|
| 327044 | 5/1929 | United Kingdom | 29/157.4 |

*Primary Examiner*—E. M. Combs
*Assistant Examiner*—V. K. Rising
*Attorney, Agent, or Firm*—James C. Wray

[57] ABSTRACT

In a heat exchanger, ends of adjacent heat-conducting pipes are flattened to form joining faces and these faces are butt-welded together to form a parallel pipe heat exchanger without end plates.

6 Claims, 17 Drawing Figures

GATHERING THE ENDS OF HEAT-CONDUCTING PIPES IN HEAT EXCHANGERS

BACKGROUND OF THE INVENTION

The present invention relates to a method of gathering the ends of heat-conducting pipes in a heat exchanger without use of end plates.

In the conventional practice of gathering the ends of heat-conducting pipes in a heat exchanger, many holes are bored in end plates; the ends of heat-conducting pipes are fitted into the holes; and ends of the pipes are welded to the end plates. In welding of the pipe ends to the end plates, however, the thermal strain due to thermal expansion in the longitudinal direction of the heat-conducting pipes cannot be absorbed, and in the worst case the end plates are broken owing to the thermal strain in the pipes. Meanwhile welding execution makes it impossible to narrow the interval between adjacent holes in the end plate, and accordingly the heat exchanger cannot be made compact in configuration. When welding is executed with the interval between adjacent holes unreasonably narrowed, the thermal strain in the adjacent pipes cannot be absorbed, resulting in failure of the pipes or in cracking of the end plate.

Impossibility of narrowing the interval between holes in the end plate means impossibility of narrowing the gap between adjacent pipes. Therefore, the flow of the fluid passing through the space formed around adjacent pipes is retarded and in consequence a laminar flow develops around the pipes, impeding heat transfer between the fluid in the heat-conducting pipes and the fluid passing through the gaps between adjacent pipes, with the result that the efficiency of heat transfer drops.

SUMMARY OF THE INVENTION

The present invention, which aims at elimination of the above inconvenience, is characterized in that the pipe ends are flattened to provide the joining faces, the pipes are gathered with these flattened ends butt-welded, and at the same time the gap between the heat-conducting pipes is narrowed, thereby accelerating the flow of the fluid passing through the space formed between the heat-conducting pipes.

An object of the present invention is to provide a method of gathering the ends of heat-conducting pipes in a heat exchanger and an apparatus with gathered ends of pipes in a heat exchanger, characterized in that the ends of adjacent heat-conducting pipes are flattened to form the joining faces and these faces are butt-welded.

Another object of the present invention is to provide a heat exchanger apparatus and a method of gathering the ends of heat-conducting pipes in a heat exchanger in which the gap between the heat-conducting pipes is made as narrow as possible and the flow of the fluid passing through the space formed between the heat-conducting pipes is made fast.

Several other objects of the present invention will become apparent from the following detailed account of embodiments of the present invention referring to the attached drawings.

DETAILED DESCRIPTION OF THE DRAWINGS

Figure 1:
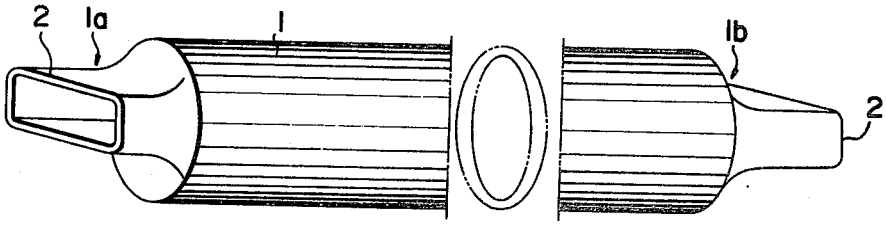
FIG. 1 is a front view of a heat-conducting pipe employed in one embodiment of the present invention.
Figure 2:
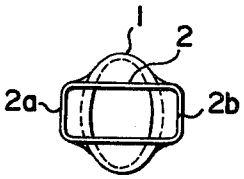
FIG. 2 is a side view corresponding to FIG. 1.
Figure 3:
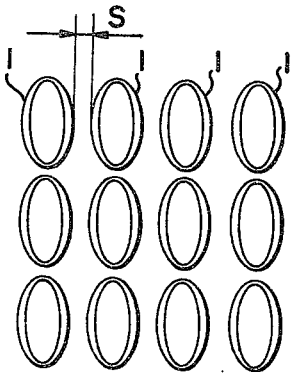
FIG. 3 is a section view along III—III of FIG. 4.
Figure 4:
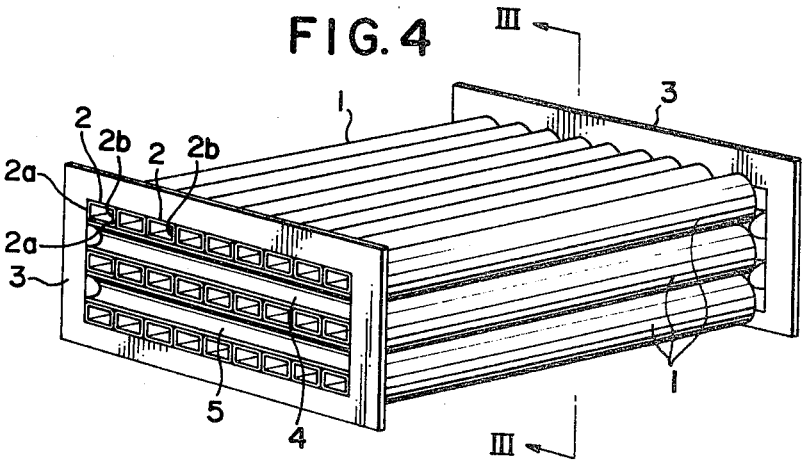
FIG. 4 is an oblique view illustrating one embodiment of the present invention.

In FIGS. 1 and 2, both ends 1*a* and 1*b* of the heat-conducting pipe 1, elliptical in section, are crushed toward the minor axis of the ellipse to form the joining faces 2, which are rectangular in section. Side joining faces 2*a*, 2*b* are projected equally from both sides of the pipe 1 outward along the extended minor axis of ellipse. As seen in FIGS. 3 and 4, a number of such pipes 1 are arranged parallel to one another in a grid pattern. Side faces 2*a* and 2*b* of pipes 1 adjoining in the lateral direction are butted against each other to gather the ends 1*a*, 1*b* of the pipes 1, and these faces 2*a*, 2*b* are welded together. Opposite ends of the pipes 1 are welded together in the same way.

By changing the extent of projection of the faces 2*a* and 2*b* from both sides of the pipes 1 the gaps S, formed between adjacent pipes 1 can be arbitrarily set. Therefore the velocity of the fluid flow in the gap S can be increased by changing the extent of projection of the faces 2*a* and 2*b*.

The joining faces 2 of the pipes 1 which are gathered are fitted within a frame 3, and pipes 1 are positioned using said frame 3. Elastically deformable sleeves 4 and 5, which are thermal strain-compensating members, are inserted in the spaces formed between end faces of rows of pipes 1 located in frame 3. Contacting faces of pipe ends 2, members 4 and 5, and frame 3 are butt-welded. Thermal strain of faces 2 in the lateral direction of the pipe ends major axes (the vertical direction in FIG. 4) caused by thermal expansion is compensated by deformation of said sleeves 4 and 5. The thermal strain in the longitudinal direction of the welded faces 2 (the horizontal direction in FIG. 4) is compensated by the strain due to thermal expansion of the frame 3, which is fabricated of the same material as the heat-conducting pipes 1. Thermal strain in the longitudinal direction of the pipes 1 is compensated by warping or bending of the pipes in the gaps between the adjacent heat-conducting pipes 1.

A first fluid to be preheated flows in the pipe 1, while a second fluid to preheat the first fluid flows through the gaps formed between the adjacent heat-conducting pipes 1.

Figure 5:
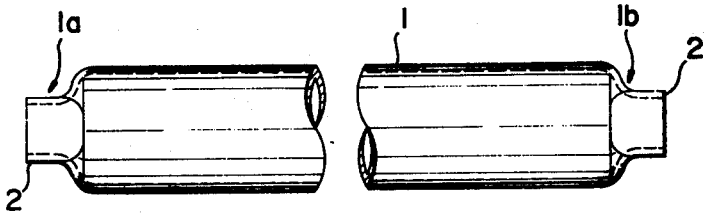
FIG. 5 is a front view of a heat-conducting pipe employed in a second embodiment of the present invention.
Figure 6:
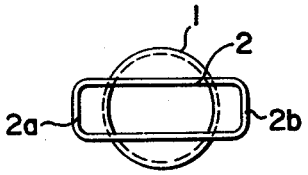
FIG. 6 is a side view corresponding to FIG. 5.

Next, a second embodiment of the present invention is to be described. Unlike the preceding example in which heat-conducting pipes are oval in section, in this example heat-conducting pipes are circular in section. In FIGS. 5 and 6, both ends 1*a*, *1b* of the circular cross-section pipe 1 are crushed to a rectangular form. At longitudinal extremities of these rectangular ends a pair of faces 2*a* and 2*b* *are formed projecting equally from both sides of pipe 1.*

Figure 7:
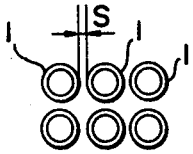
FIG. 7 is a section view along VII—VII of FIG. 8.
Figure 8:
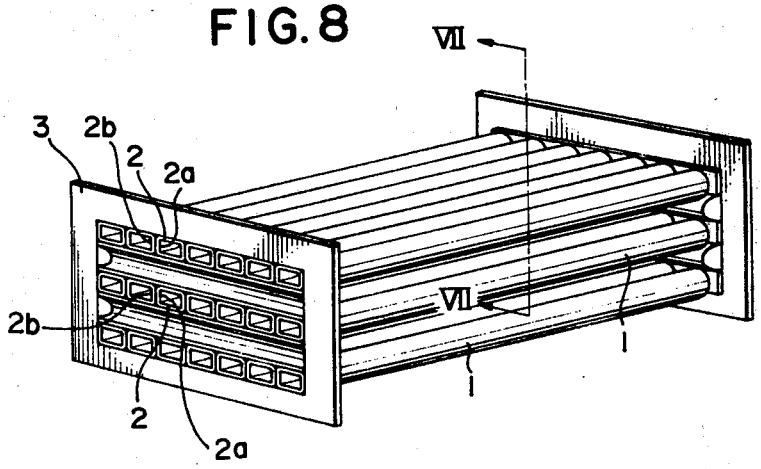
FIG. 8 is an oblique view illustrating the second embodiment of the present invention.

Then, as shown in FIGS. 7 and 8, a large number of pipes 1 are arranged parallel to one another in a grid pattern. The faces 2*a* and 2*b* of laterally adjacent pipes 1 are butted against each other, and, with ends 1*a* and 1*b* of each pipe 1 gathered, these faces are welded together. Meanwhile the butt-joining of the faces 2*a* and 2*b* of pipes 1 creates gaps S between the adjacent pipes 1. Through the gaps S flows a fluid which preheats the fluid in the heat-conducting pipes 1. The size of the gap S between the adjacent pipes 1 is variable by changing the extent of projection of the faces 2*a* and 2*b* from both sides of the pipes 1; therefore by narrowing the gap S through adjustment of projection of the faces 2*a* and 2*b*, the velocity of fluid flow through the gaps S can be increased. The ends 1*a* and 1*b* of pipes 1 are gathered and fitted within the frame 3; and using the frame 3, the welding of the ends 2 of the pipes 1 is done.

Then elastically deformable sleeves 4 and 5 are inserted in the spaces formed between the faces 2 of longitudinally adjacent pipes 1 in FIG. 7. Thereby the thermal strain due to thermal expansion in the lateral direction (the vertical direction in FIG. 8) of the faces 2 is compensated by deformation of said sleeves 4 and 5. Thermal strain in the longitudinal direction (the horizontal direction in FIG. 8) of the welded faces 2 is also compensated by deformation of said sleeves 4 and 5. And the thermal strain in the longitudinal direction of the welded faces 2 (the horizontal direction in FIG. 8) is compensated by the strain due to thermal expansion of the frame 3, which is fabricated of the same material as the heat-conducting pipes 1. Thermal strain in the longitudinal direction of the pipes 1 is compensated at the gaps S between the adjacent pipes 1.

Next a third embodiment of the present invention is to be described. Whereas in the second example the pipes 1 are arranged in a grid pattern, in this example they are staggered in arrangement.

Figure 9:
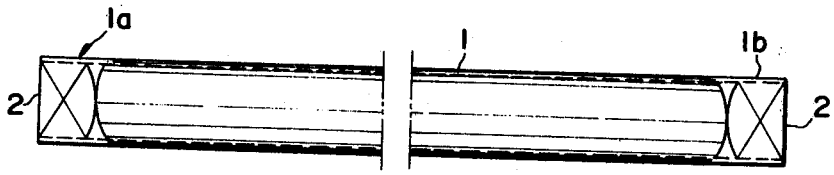
FIG. 9 is a front view of a heat-conducting pipe employed in a third embodiment of the present invention.
Figure 10:
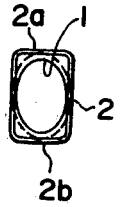
FIG. 10 is a side view corresponding to FIG. 9.

In FIGS. 9 and 10, both ends 1*a* and 1*b* of the pipe 1, oval in section, are enlarged to form a rectangular end 2. At the longitudinal extremities of this end 2 are formed the joining faces 2*a* and 2*b*.

Figure 11:
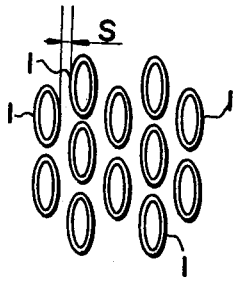
FIG. 11 is a section view along XI—XI of FIG. 12.
Figure 12:
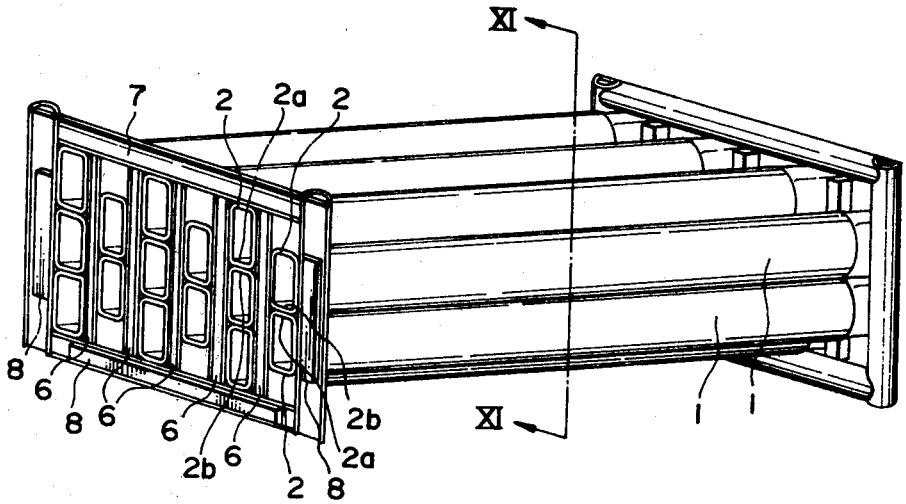
FIG. 12 is an oblique view illustrating the third embodiment of the present invention.

A large number of pipes 1 are arranged in staggered fashion parallel to one another as shown in FIG. 11. The faces 2*a* and 2*b* of longitudinally adjacent pipes 1 are butted against each other and, with the ends 1*a* and 1*b* of pipes 1 gathered, said faces 2*a*, 2*b* are welded together.

Spacers 6 are inserted between laterally adjacent pipes 1, and are welded to the long faces of ends 2, thereby creating gaps S between pipes 1. A fluid to preheat the fluid in pipes 1 is passed through gaps S. In the illustrated embodiment the gaps S are created by the spacers 6. The gaps may be created by extending the faces 2 toward laterally adjacent pipes 1 and butt-joining the extended portions of the faces 2.

The ends 1*a* and 1*b* of pipes 1 are fitted in an elastically formable frame 7, which holds the positions of the ends 1*a*, 1*b* of the pipes 1.

Frame 7 carries a plate 8 which bears the longitudinal and lateral loads. Thereby the thermal strain at the ends 1*a* and 1*b* of the pipes 1 is compensated by deformation of said frame 7, while the thermal strain in the longitudinal direction of the pipe 1 is compensated in the gaps S.

Next a fourth embodiment of the present invention is to be described. In the preceding examples the heat-conducting pipes 1 are oval or circular in section, but in this example the pipes 9 are rectangular in section.

Figure 13:
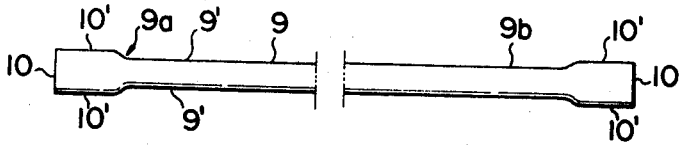
FIG. 13 is a plan view of a heat-conducting pipe employed in a fourth embodiment of the present invention.
Figure 14:
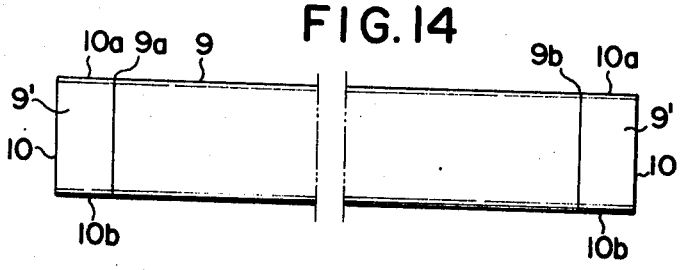
FIG. 14 is a front view corresponding to FIG. 13.

In FIGS. 13 and 14, both ends 9*a* and 9*b* of a rectangular pipe 9 are enlarged from the long side 9' to form a rectangular end 10, the long side 10' of which is extended from both sides of the pipe 9, and a pair of faces 10*a*, 10*b* are formed in the longitudinal direction of said end 10.

Figure 15:
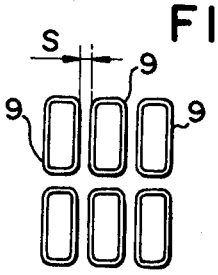
FIG. 15 is a section view along XV—XV of FIG. 17.
Figure 16:
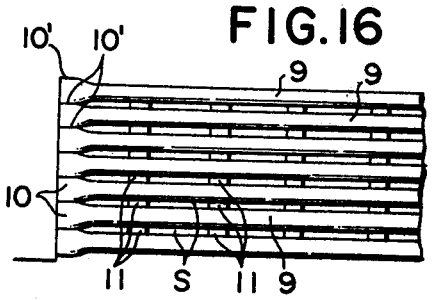
FIG. 16 is a plan view corresponding to FIG. 17.
Figure 17:
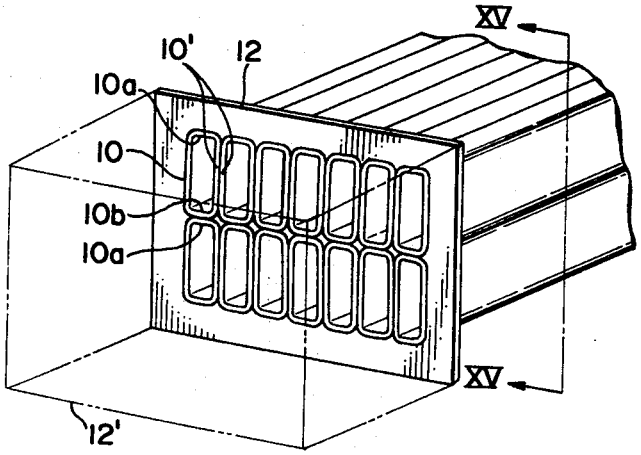
FIG. 17 is an oblique view illustrating the fourth embodiment of the present invention.

As illustrated in FIG. 15, 16 and 17, a large number of pipes 9 are arranged in a grid pattern parallel to one another. Faces 10*a*, *10b* of longitudinally adjacent pipes 9 are butted against each other and, with ends 9*a*, 9*b* of pipes 9 gathered, faces 10*a*, 10*b* are welded together. Meanwhile gaps S are created between laterally adjacent pipes 9 by butt-welding together the faces 10' of laterally adjacent pipes 9. Diamond shaped areas at corners of pipe ends are filled with flowed welding material. Tips 11 extend outward from pipe sides to touch laterally adjacent pipes 9, thereby reinforcing each pipe 9 and at the same time narrowing the flow path of the fluid passing through the gaps S and widening the heat-conducting area.

The ends 9*a*, 9*b* of the gathered pipes 9 are fitted in a frame 12, by which the positioning of the ends 9*a*, 9*b* of the pipe 9 is done. Thermal strain at the ends 9*a*, 9*b* of the pipe 9 is compensated by the strain due to thermal expansion of frame 12, which is fabricated of the same material as the pipe 9. Thermal strain in the longitudinal direction of the pipe 9 is compensated by longitudinal bending of it. Instead of using the frame 12, as indicated by a two-dot chain line a box 12' may be used for positioning of the ends 9*a* and 9*b*.

In the examples, ends of the pipes are crushed to rectangular sections to provide joining faces, but these ends may be formed polygonal in section, provided joining faces can be formed at the ends of adjacent pipes.

In most of the examples a frame is employed, but a box as illustrated in the fourth example may be employed for positioning of the ends 9*a*, 9*b*.

As described above, in the present invention joining faces are provided at the ends of heat-conducting pipes, and by butt-welding these faces of pipes arranged parallel to one another, the ends of the pipes are gathered. As a result the end plate is rendered needless; the gap formed between adjacent pipes is easily varied by merely changing the sizes of joining faces and the body of the heat exchanger can be made compact. Meanwhile the possibility of narrowing the gaps between pipes implies the possibility of increasing the velocity of fluid flow through the gap, which prevents development of a laminar flow around the pipes, resulting in an increased efficiency of heat transfer promoted between the fluid in the pipes and the fluid in the gaps between pipes.

What is claimed is:

1. In the manufacture of a heat exchanger, in which a fluid to be preheated is passed in the heat-conducting pipes having oval cross sections and a hot fluid is passed through a gap formed between these oval pipes, thereby causing heat transfer between said fluid in the pipes and said hot fluid in the gap between the pipes, a method of gathering and holding ends of plural heat-conducting pipes characterized in radially distorting the ends of adjacent oval pipes and flattening portions of the ends to form faces by deforming inwardly parallel to longest dimensions of the oval cross sections and forming thereby relatively long faces and deforming outwardly parallel to shortest dimensions of the oval cross sections and forming thereby relatively short outward extended joining faces and gathering these ends and abutting and joining together said joining faces of each pipe with joining faces of other pipes, and surrounding the joined ends with a thermal strain-compensating frame made of the same material as the pipes.

2. A method of gathering and holding the ends of heat-conducting pipes in a heat exchanger claimed in claim 1, characterized in that the pipes with joining faces provided at ends are held parallel to one another and arranged in a grid pattern.

3. A method of gathering the ends of heat-conducting pipes in a heat exchanger claimed in claim 1 characterized in inserting a thermal strain-compensating member between the ends of adjacent pipes.

4. A method of gathering and holding the ends of heat-conducting pipes in a heat exchanger claimed in claim 1, wherein the pipes have elliptical cross sections with perpendicular major and minor axes and wherein the deforming inwardly comprises deforming portions of the ends inwardly in directions parallel to the major axes and thereby forming the relatively long faces parallel to the minor axes and wherein the outward deforming comprises outward deforming portions of the ends in the directions of minor axes of the elliptical cross sections and forming joining faces perpendicular to minor axes of the elliptical cross sections.

5. A method of forming a heat exchanger comprising radially outwardly deforming first and second opposite portions of ends of a curvilinear oval tube and transversely radially inwardly deforming second and third opposite portions of the ends, thereby forming rectangular ends, and forming first and second opposite relatively small parallel faces extended outward beyond the curvilinear portion of the oval tube from the first and second portions, and forming from the second and third portions, second and third opposite and elongated faces connecting the relatively short faces, the elongated faces being parallel to each other and being spaced apart a distance less than a diametrical dimension of the curved tube, and surrounding the ends with a thermal strain-compensating frame made of the same material as the tubes.

6. A method of forming a heat exchanger of claim 5 wherein relatively short faces of adjacent tubes are abutted and joined and wherein elongated faces of adjacent tubes are spaced by a curved thermal strain-compensating member.

* * * * *